US012025397B2

(12) United States Patent
Darby et al.

(10) Patent No.: US 12,025,397 B2
(45) Date of Patent: Jul. 2, 2024

(54) FIREARM MAGAZINE FOLDABLE CARRYING DEVICE

(71) Applicant: ULTICLIP, LLC, Orlando, FL (US)

(72) Inventors: Randall Lynn Darby, Chicago, IL (US); Clayton Andrew Bass, Bourbonnais, IL (US)

(73) Assignee: ULTICLIP, LLC, Orlanda, FL (US)

( * ) Notice: Subject to any disclaimer, the term of this patent is extended or adjusted under 35 U.S.C. 154(b) by 0 days.

(21) Appl. No.: 18/154,989

(22) Filed: Jan. 16, 2023

(65) Prior Publication Data

US 2023/0304759 A1 Sep. 28, 2023

Related U.S. Application Data

(60) Provisional application No. 63/269,919, filed on Mar. 25, 2022.

(51) Int. Cl.
*F41A 9/80* (2006.01)

(52) U.S. Cl.
CPC ..... *F41A 9/80* (2013.01)

(58) Field of Classification Search
CPC ..... F41A 9/36; F41A 9/65
USPC ..... 42/49.01
See application file for complete search history.

(56) References Cited

U.S. PATENT DOCUMENTS

| | | | | | |
|---|---|---|---|---|---|
| 1,308,665 | A * | 7/1919 | Douglas | F41A 9/65 | 89/34 |
| 5,009,022 | A * | 4/1991 | McCoy | F41C 33/001 | 42/106 |
| 2003/0046850 | A1* | 3/2003 | Beretta | F41A 9/65 | 42/50 |
| 2005/0011097 | A1* | 1/2005 | Freed | F41A 9/65 | 42/49.02 |
| 2010/0154269 | A1* | 6/2010 | Escalante, III | F41A 9/65 | 42/49.01 |
| 2017/0205168 | A1* | 7/2017 | Chen | F41C 23/10 | |
| 2020/0348095 | A1* | 11/2020 | Lee | F41A 9/71 | |

* cited by examiner

*Primary Examiner* — Bret Hayes
(74) *Attorney, Agent, or Firm* — INNOVATION CAPITAL LAW GROUP, LLP; Vin Lin

(57) ABSTRACT

A firearm magazine carrying device includes a base and clip, where the clip portion can fold into the base. When the device is attached to or integrated into a firearm magazine baseplate, it allows the attachment of a firearm magazine to an article of clothing, pocket, bag, or other places where it is desired to secure a firearm magazine, without the aid of a carrier, pouch, or other devices.

9 Claims, 4 Drawing Sheets

FIREARM MAGAZINE FOLDABLE CARRYING DEVICE

CROSS-REFERENCE TO RELATED APPLICATIONS

This application claims the benefit of priority to U.S. provisional patent application No. 63/269,919, filed Mar. 25, 2022, the contents of which are herein incorporated by reference.

BACKGROUND OF THE INVENTION

1. Field of the Invention

Embodiments of the invention relate generally to firearm magazine carrying devices. More particularly, embodiments of the invention relate to devices that can be integrated into or attached to a firearm magazine so that the user can securely carry a firearm magazine by utilizing a retracting clip to attach it to a person's pocket, waistband, bag, pouch, belt, or other strapping, webbing, or wearable object.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Carrying a firearm magazine has been performed by inserting the magazine into a pouch, bandoleer, carrier, or some other dedicated carrying device. A person may also choose to carry a firearm magazine in a clothing pocket, or bag. Presently, there are no solutions that directly integrate a firearm magazine carrying solution onto or into the magazine baseplate itself, allowing the firearm magazine to function as designed without hindrance or user intervention.

In view of the foregoing, there is a need for an improved device for securely carrying a firearm magazine.

SUMMARY OF THE INVENTION

According to one aspect of the present invention, a device is provided that allows a user to securely carry a firearm magazine by directly integrating a carrying clip onto or into the firearm magazine baseplate without interfering with the function or use of the firearm magazine.

Embodiments of the present invention provide a device for carrying a firearm magazine comprising a base member having a back side operable to attach to a firearm magazine without interfering with use of the firearm magazine within a firearm; and a clip member, the clip member pivotable between a use position, where the clip extends away from a top side of the base member, and a stowed position, where the clip is disposed at least partially within a clip channel formed in the top side of the base member.

Embodiments of the present invention further provide a device for carrying a firearm magazine comprising a base member having a back side operable to attach to a firearm magazine without interfering with use of the firearm magazine within a firearm; and a clip member, the clip member pivotable between a use position, where the clip extends away from a top side of the base member, and a stowed position, where the clip is disposed at least partially within a clip channel formed in the top side of the base member, wherein in the stowed position, a majority of the clip is stowed completely within the clip channel without extending beyond a top side surface of the base member; and the base member is integral with the firearm magazine and forms a firearm magazine baseplate base of the firearm magazine.

Embodiments of the present invention also provide a device for carrying a firearm magazine comprising a base member having a back side operable to attach to a firearm magazine without interfering with use of the firearm magazine within a firearm; and a clip member, the clip member pivotable between a use position, where the clip extends away from a top side of the base member, and a stowed position, where the clip is disposed at least partially within a clip channel formed in the top side of the base member, wherein in the stowed position, a majority of the clip is stowed completely within the clip channel without extending beyond a top side surface of the base member; and the back side of the base member attaches to a firearm magazine baseplate base of the firearm magazine.

In some embodiments, in the use position, the clip extends outward from a side of the base member.

In some embodiments, the clip channel includes a cut out center region formed in at least the top side of the base member, the cut out center region permits a user to access sides of the clip when the clip is in the stowed position.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1A:
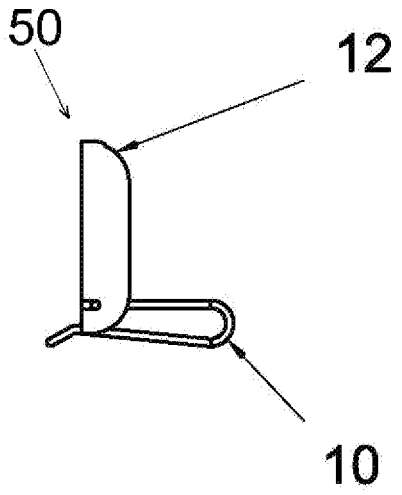
FIG. 1A illustrates side view of an attachable firearm magazine foldable carrying device with its clip in the extended position, according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide firearm magazine carrying device that includes a base and clip where the clip portion can fold into the base. When the device is attached to or integrated into a firearm magazine baseplate, it allows the attachment of a firearm magazine to an article of clothing, pocket, bag, or other places where it is desired to secure a firearm magazine, without the aid of a carrier, pouch, or other devices. The clip and the base are assembled to create a single unit. The base can be configured as a separate entity from a firearm magazine baseplate or can replace and function as a firearm magazine baseplate.

In some embodiments, the base and the clip of the firearm magazine foldable carrying device can be constructed out of metal or plastic. Each component is typically formed out of a single piece of the desired material and assembled as described below.

Figure 1B:
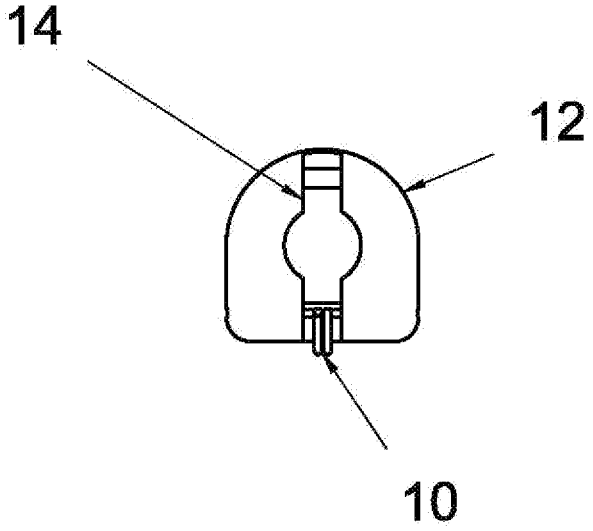
FIG. 1B illustrates a top view of the attachable firearm magazine foldable carrying device of FIG. 1A.
Figure 1C:
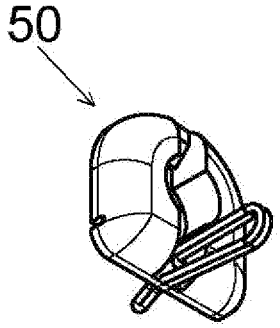
FIG. 1C illustrates a perspective view of the attachable firearm magazine foldable carrying device of FIG. 1A.

Referring to FIGS. 1A through 1C, a firearm magazine foldable carrying device 50 (also referred to as carrying device 50) can include a base 12 and a clip 10 pivotably attached to the base 12. FIGS. 1A through 1C show the carrying device 50 with the clip 10 in the extended state. The assembled carrying device 50 can be affixed to any firearm magazine base plate. It may be affixed using, but not limited to, adhesive, tape, glue, or screwed into place.

When the clip 10 is in the extended state and the base 12 is adhered to a firearm magazine, the carrying device 50 is ready to be utilized to secure a firearm magazine to clothing, a bag, a pocket, or any location that the clip will fit onto, without the aid of any other device. A clip channel 14 can be formed through the base 12 and its purpose will be described in greater detail below.

The clip 10, when in the use position, can permit the user to easily slide the firearm magazine onto its carrying location. The clip 10 can resiliently deform to permit the clip 10 to securely attach at its desired carrying location, while permitting the user to easily slide the clip off its carrying location and use the firearm magazine as usual. The device of the present invention can be attached to the firearm magazine and used to conveniently carry a firearm magazine without interfering with the use thereof. A user can removably or permanently attach the device to each of their firearm magazines to permit each magazine to be easily carried and then readily available for use.

Figure 2A:
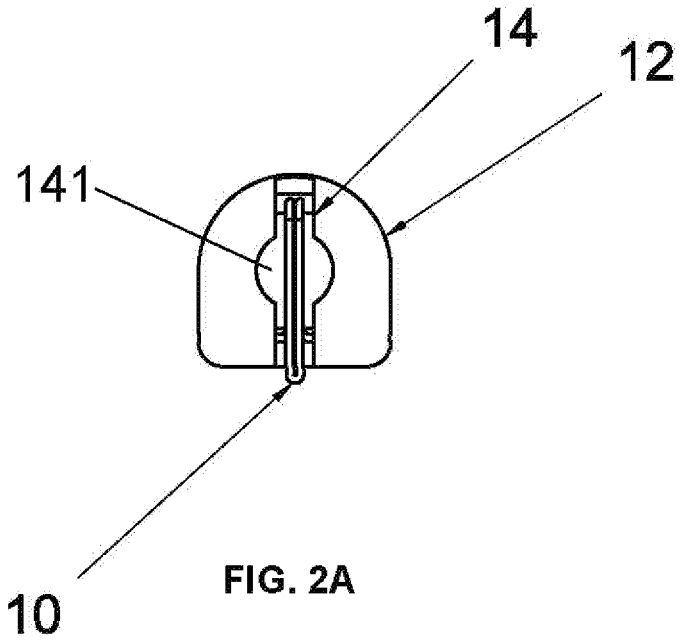
FIG. 2A illustrates a top view of the attachable firearm magazine foldable carrying device of FIG. 1A with the clip in the folded position.
Figure 2B:
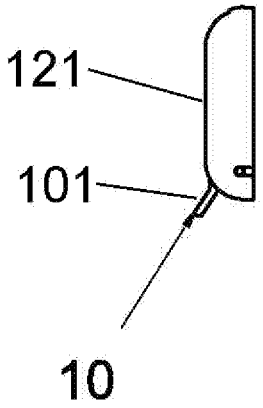
FIG. 2B illustrates a side view of the attachable firearm magazine foldable carrying device of FIG. 2A.
Figure 2C:
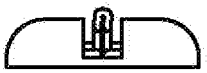
FIG. 2C illustrates a front view of the attachable firearm magazine foldable carrying device of FIG. 2A.
Figure 2D:
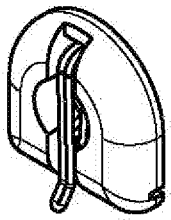
FIG. 2D illustrates a perspective view of the attachable firearm magazine foldable carrying device of FIG. 2A.

FIGS. 2A through 2D show the firearm magazine foldable carrying device 50 described above, with the clip assembled with the base 12 and the clip 10 being shown in the folded state into the clip channel 14. The clip channel 14 allows the clip 10 to be recessed into the base 12. When the clip 10 is folded into the base 12, the firearm magazine is free to be used as originally designed, when inserting the firearm magazine into a firearm. The foldability of the clip 10 into the base 12 allows the user to have the ability to clip a magazine to one's clothing or accessories, and be able to manipulate and utilize the magazine for its original purpose and design. As best seen in FIG. 2B, an outer face 121 of the base 12 is free from any portion of the clip 10 protruding therefrom with the clip 10 is in the folded state. A tip 101 of the clip 10 may extend outward from the base 12 to provide an access point for a user to readily remove the clip from its folded state.

In some embodiments, the clip channel 14 can include a protrusion or some other form of securing mechanism to secure the clip 10 in the stowed position. The securing mechanism can be a deformable tab, a resilient protrusion, a friction fit, or the like. By having the securing mechanism, the clip 10 can be retained in the clip channel 14 when the firearm magazine is in use. The securing mechanism may be strong enough, for example, to hold the clip 10 in the clip channel 14 during use of the firearm magazine, including during recoil, for example, while permitting the user to readily grasp the clip 10 to move it into the use position.

In some embodiments, even the tip 101 of the clip 10 may be retained within an outer periphery boundary of the base 12, where the clip channel 14 can include a cut out center region 141 to permit s user to reach the clip 10 to deploy the clip 10 out of the folded state.

Figure 3A:
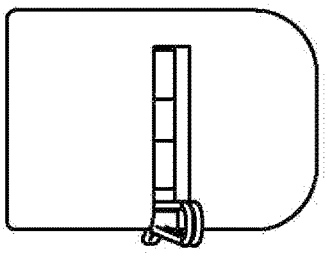
FIG. 3A illustrates a top view of a firearm magazine with a firearm magazine foldable carrying device integrated into the magazine baseplate with the clip of the firearm magazine foldable carrying device extended, according to an exemplary embodiment of the present invention.
Figure 3B:
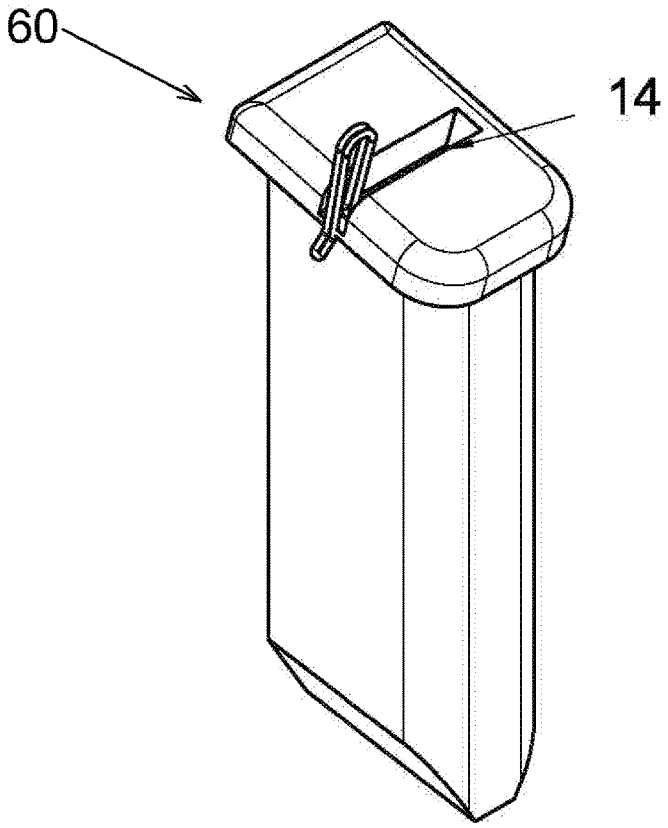
FIG. 3B illustrates a perspective view of the integrated firearm magazine/firearm magazine foldable carrying device of FIG. 3A.
Figure 3C:
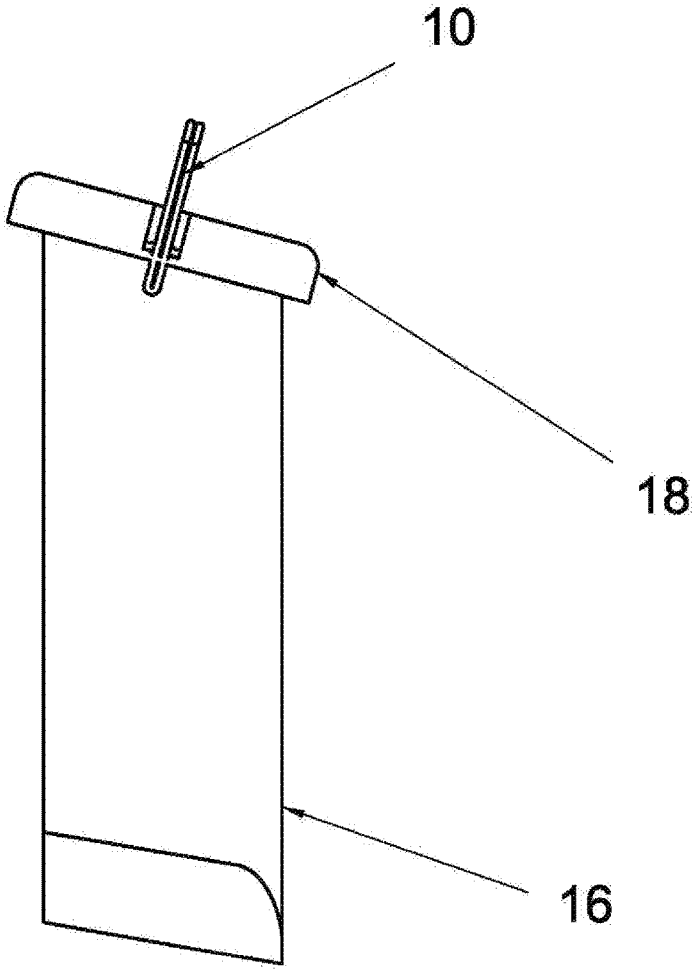
FIG. 3C illustrates a side view of the integrated firearm magazine/firearm magazine foldable carrying device of FIG. 3A.

Referencing FIGS. 3A through 3C, a firearm magazine foldable carrying device 60 (also referred to as carrying device 60) is shown. A firearm magazine 16 is represented, including a firearm magazine baseplate base 18 with the clip 10 assembled into the firearm magazine baseplate base 18. The clip 10 is shown in the extended position. The firearm magazine baseplate base 18 can replace a standard firearm magazine baseplate and can provide the same function as a standard magazine baseplate while allowing the user all the functions of the firearm magazine foldable carrying device 60. In this embodiment, the carrying device would add little, if any, length to the firearm magazine as compared with a conventional firearm magazine with a standard magazine baseplate.

Figure 4A:
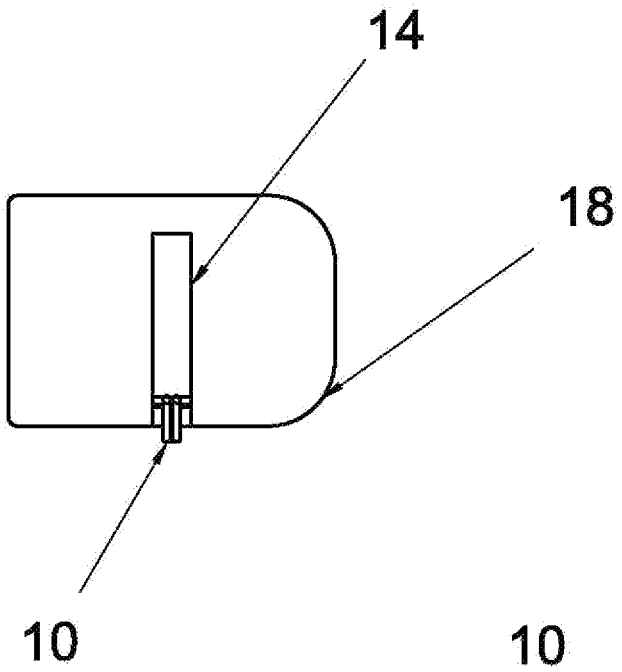
FIG. 4A illustrates a top view of a firearm magazine baseplate with a firearm magazine foldable carrying device integrated into the magazine baseplate, with the clip of the firearm magazine foldable carrying device extended, according to an exemplary embodiment of the present invention.
Figure 4B:
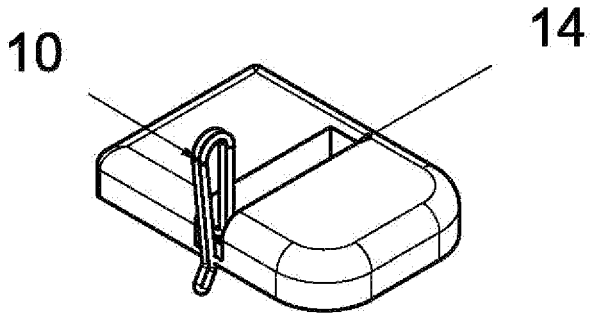
FIG. 4B illustrates a perspective view of the integrated firearm magazine baseplate/firearm magazine foldable carrying device of FIG. 4A.
Figure 4C:
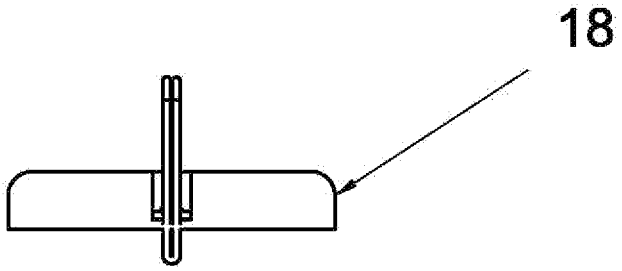
FIG. 4C illustrates a side view of the integrated firearm magazine baseplate/firearm magazine foldable carrying device of FIG. 4A.

FIGS. 4A through 4C depicts the firearm magazine baseplate base 18 without the firearm magazine 16. The clip 10 is shown in the extended position. The firearm magazine baseplate base 18 would include the clip channel 14 which would allow the clip 10 to fold into the firearm magazine baseplate base 18 as described in the description above.

While FIGS. 3A through 4C show the clip pivoting along a side of the firearm magazine 16, it should be understood that the clip may pivot at a front or rear of the firearm magazine 16.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A device for carrying a firearm magazine, comprising:

a base member having a back side operable to attach to a firearm magazine without interfering with use of the firearm magazine within a firearm;

a clip member, the clip member pivotable between a use position, where the clip extends away from a top side of the base member, and a stowed position, where the clip is disposed at least partially within a clip channel formed in the top side of the base member, wherein the clip channel includes a cut out center region formed in at least the top side of the base member, the cut out center region permits a user to access sides of the clip when the clip is in the stowed position.

2. The device for carrying a firearm magazine of claim 1, wherein, in the stowed position, a majority of the clip is stowed completely within the clip channel without extending beyond a top side surface of the base member.

3. The device for carrying a firearm magazine of claim 1, wherein the back side of the base member attaches to a firearm magazine baseplate base of the firearm magazine.

4. The device for carrying a firearm magazine of claim 1, wherein the base member is integral with the firearm magazine and forms a firearm magazine baseplate base of the firearm magazine.

5. The device for carrying a firearm magazine of claim 1, wherein, in the use position, the clip extends outward from a side of the base member.

6. A device for carrying a firearm magazine, comprising:

a base member having a back side operable to attach to a firearm magazine without interfering with use of the firearm magazine within a firearm; and a clip member, the clip member pivotable between a use position, where the clip extends away from a top side of the base member, and a stowed position, where the clip is disposed at least partially within a clip channel formed in the top side of the base member, wherein in the stowed position, a majority of the clip is stowed completely within the clip channel without extending beyond a top side surface of the base member;

the base member is integral with the firearm magazine and forms a firearm magazine baseplate base of the firearm magazine; and, the clip channel includes a cut out center region formed in at least the top side of the base member, the cut out center region permits a user to access sides of the clip when the clip is in the stowed position.

7. The device for carrying a firearm magazine of claim 6, wherein, in the use position, the clip extends outward from a side of the base member.

8. A device for carrying a firearm magazine, comprising:

a base member having a back side operable to attach to a firearm magazine without interfering with use of the firearm magazine within a firearm; and a clip member, the clip member pivotable between a use position, where the clip extends away from a top side of the base member, and a stowed position, where the clip is disposed at least partially within a clip channel formed in the top side of the base member, wherein in the stowed position, a majority of the clip is stowed completely within the clip channel without extending beyond a top side surface of the base member;

the back side of the base member attaches to a firearm magazine baseplate base of the firearm magazine; and the clip channel includes a cut out center region formed in at least the top side of the base member, the cut out center region permits a user to access sides of the clip when the clip is in the stowed position.

9. The device for carrying a firearm magazine of claim 8, wherein, in the use position, the clip extends outward from a side of the base member.

* * * * *